US012503283B1

(12) United States Patent
Vovan

(10) Patent No.: US 12,503,283 B1
(45) Date of Patent: Dec. 23, 2025

(54) INNOVATIVE TAMPER-EVIDENT AND CHILD-SAFETY CONTAINER

(71) Applicant: Terry Vovan, Anaheim, CA (US)

(72) Inventor: Terry Vovan, Anaheim, CA (US)

( * ) Notice: Subject to any disclaimer, the term of this patent is extended or adjusted under 35 U.S.C. 154(b) by 0 days.

(21) Appl. No.: 18/800,001

(22) Filed: Aug. 9, 2024

Related U.S. Application Data

(63) Continuation-in-part of application No. 18/542,522, filed on Jul. 2, 2024.

(51) Int. Cl.

| | |
|---|---|
| ***B65D 50/04*** | (2006.01) |
| ***B65D 41/34*** | (2006.01) |
| ***B65D 51/24*** | (2006.01) |
| ***B65D 51/30*** | (2006.01) |

(52) U.S. Cl.
CPC ..... *B65D 50/048* (2013.01); *B65D 41/3428* (2013.01); *B65D 51/245* (2013.01); *B65D 51/30* (2013.01); *B65D 2203/02* (2013.01); *B65D 2215/02* (2013.01); *B65D 2401/35* (2020.05)

(58) Field of Classification Search
CPC ..... B65D 41/3419; B65D 41/3409; B65D 41/3414; B65D 41/34; B65D 41/3404; B65D 50/048; B65D 41/3428; B65D 51/245; B65D 51/30; B65D 2203/02; B65D 2215/02; B65D 2401/35
See application file for complete search history.

(56) References Cited

U.S. PATENT DOCUMENTS 3,181,718 A 5/1965 Chancellor
3,612,320 A * 10/1971 Wassilieff ..... B65D 41/0435 215/316

(Continued)

FOREIGN PATENT DOCUMENTS

CA 2533194 2/2005
EP 2020242438 5/2019

(Continued)

OTHER PUBLICATIONS

U.S. Appl. No. 12/689,882, filed Jan. 19, 2010, Titherington.
U.S. Appl. No. 15/237,245, filed Aug. 15, 2015, Bei Guo.

*Primary Examiner* — Kareen K Thomas
(74) *Attorney, Agent, or Firm* — Grants Law Firm; Allan Grant

(57) ABSTRACT

This invention is method of manufacturing of child-resistant and tamper-evident packaging container, which the cap having a tamper-evident feature on the top and a press-tab on the side wall. This cap provides both tamper-evident and child safety features to warn and protect consumers as well as dispensers such as: pharmacists, hospitals, medical centers, and manufacturers that the containers have not been opened and accurately reflect the number of pills in the container. The cap's distinctive feature enables the pharmacist and medical staff or provider to securely fasten by rotating it clockwise, while the patient turns the cap counterclockwise to open it for the first time. However, this process will break off the tamper-evident feature away from the outside cap, which indicates tampering and exposes the upper surface of the inner lid, where additional marking displays, i.e., "OPENED" to warn of tampering. The cap continues function a child-resistant container thereon.

40 Claims, 11 Drawing Sheets

(56) References Cited

U.S. PATENT DOCUMENTS 3,630,403 A * 12/1971 Berg ..... B65D 50/064 215/221
3,735,887 A 5/1973 Morris
3,799,392 A * 3/1974 Richards ..... B65D 50/045 220/326
3,863,798 A * 2/1975 Kurihara ..... B65D 55/12 215/301
4,562,931 A * 1/1986 Brach ..... B65D 50/041 215/256
4,673,095 A * 6/1987 Puresevic ..... B65D 50/041 215/220
4,801,028 A * 1/1989 Puresevic ..... B65D 50/041 215/220
5,005,718 A * 4/1991 Buono ..... B65D 50/041 215/220
5,509,550 A 4/1996 DeJonge
5,762,215 A * 6/1998 Ogden ..... B65D 50/041 215/217
6,029,834 A * 2/2000 Sanner ..... B65D 50/041 215/220
6,206,216 B1 3/2001 Stalions
6,926,161 B2 8/2005 Miceli
6,986,807 B2 1/2006 Brunk
7,661,547 B2 2/2010 Richir
7,857,154 B2 12/2010 Pedlar
7,905,820 B2 * 3/2011 Druitt ..... B65D 47/0809 215/354
7,975,862 B2 * 7/2011 Gnepper ..... A61J 7/04 215/230
8,011,525 B2 9/2011 Robinson
8,231,018 B2 * 7/2012 Gassner ..... B65D 41/3447 215/256
8,316,622 B2 11/2012 Jajoo et al.
8,333,288 B2 12/2012 Miller
8,490,804 B2 7/2013 Benoit-Gonin et al.
8,579,116 B2 11/2013 Pether et al.
8,763,830 B2 7/2014 Sadiq et al.
9,365,333 B2 6/2016 Batzel et al.
9,580,213 B2 2/2017 Dong et al.
9,926,114 B2 3/2018 Eberlein
10,239,673 B1 3/2019 Dejonge
10,383,793 B2 8/2019 Knobel et al.
10,427,842 B2 10/2019 Siskindovich et al.
11,161,656 B2 11/2021 Wang
11,217,337 B2 1/2022 McLean et al.
11,779,517 B2 10/2023 Aliakbarian
2004/0232149 A1 11/2004 Chmela
2007/0090080 A1 * 4/2007 Lohrman ..... B65D 41/325 215/258
2023/0089722 A1 3/2023 Hoonaard et al.

FOREIGN PATENT DOCUMENTS

EP 3 969387 4/2020
WO WO2018144721 1/2018

* cited by examiner

INNOVATIVE TAMPER-EVIDENT AND CHILD-SAFETY CONTAINER

CROSS-REFERENCE

This is a continuation-in-part patent application, the present application claims priority under 35 U.S.C. 120, 121, 365(c) or 386(c) and under all applicable U.S. statutes and regulations, to U.S. application Ser. No. 18/542,522. The disclosure of which is hereby incorporated herein by reference in its entirety.

FIELD OF THE INVENTION

This innovative invention relates in general to a safety plastics cap device, method of use and making. Particularly, the present disclosure relates to tamper-evident and child-safety packaging containers that are designed to warn and protect consumers as well as dispensers such as: pharmacists, hospitals, medical centers, medicine counters, and general usage that the container has not been opened.

BACKGROUND OF THE INVENTION

Far too many young children are getting into medicine containers when their parents or caregivers are not looking. US poison control centers receive about 49 calls per hour about medicine poisonings in young children. In fact, every 9 minutes, a young child goes to the emergency department (ED) because they got into a medicine container and took the medicine. Sadly, every hour, a young child is hospitalized because of a medicine poisoning, and every 12 days, a young child dies from the poisoning. In addition, there have been tampered or mixed the other medications to the original mfg. medicine containers, or accidentally swallow the small desiccant containers inside the medicine containers.

Many safety plastic caps on the market are being designed and used for pharmaceutical packaging containers to prevent children from opening the containers, but they are limited either using the plastic shrink-bands or labels to resolve the tampering evident requirement but neglecting the child safety factor, or vice versa. Particularly, the existing child safety caps present a problem for older people, patients or those that are inflicted with rheumatoid arthritis (RA), Parkinson's disease (PD) or infirmity that requires opening the medicine containers by pressing hard on the cap and rotating simultaneously.

The Food and Drug Administration (FDA) defines a tamper-evident seal as "having one or more indicators or barriers to entry which, if breached or missing, can reasonably be expected to provide visible evidence to consumers that tampering has occurred." To simplify, if the seal is removed and reapplied, or is broken, it will be obvious to consumers.

A tamper-evident system ensures consumers can be confident that the contents have not been altered from the time it is sealed at the manufacturer to the time it reaches the retail shelves. Tamper-evident seals are single use, which means that when a seal is broken, it cannot be reapplied.

The current Tamper-Evident packaging materials are: (1) Shrink Bands, (2) Over Wrap, (3) Lidding Films, (4) Resealable Standup Pouches with Tear Away Lids, (5) Induction Seals, and (6) Tamper-Evident Tape. As such, there is a need in the art for an invention that provides a device and method of use that enhances tamper-evident and child safety lid packaging designs to warn and protect consumers as well as dispensers such as: pharmacists, hospitals, or medical centers that the package has not been opened.

These tamper-evident (TE) and child-safety (CS) packaging containers are portable and convenient to use, its design consists of a container and lid or cap that contain various products from solids and gels to liquid materials. These tamper-evident (TE) and child-safety (CS) packaging containers are typically made of plastic, glass, metal, composites, or combinations of these materials or the like.

These tamper-evident (TE) and child-safety (CS) packaging containers can be used in the cosmetics, personal care, consumer or industrial products, and pharmaceutical industries where the final products are important to the end users.

These tamper-evident (TE) and child-safety (CS) packaging containers use many types of fasteners being used such as: snap-on twist lock, clamping mechanisms, thread technologies, adhesive, heat sealing, and ultrasonic welding to keep the assembly of the packaging together.

Most importantly, this unique and noble invention can be used with any standard base fastener system that is coupling the cap & container together, and provide a convenience, ergonomic, economic, and aesthetic pleasing container lid that provides a secure closure of the child safety, tamper-evident features and prolongs the product shelf life while providing a quick, convenient access to the essential products. However, these tamper-resistant products are required special and high investment closing equipment that are not suitable for the pharmacies, hospitals, medical centers, or small companies who are required a cost effective and robust TE and CS technologies.

As such, there is a need in the art for an invention that provides a device and method of use that is robust and enhances tamper-evident and child safety lid packaging design to warn and protect consumers.

SUMMARY OF INVENTION

Accordingly, it is an object of this invention to provide a child safety package that combines with the tamper-evident feature to provide a warning and protection to consumers as well as dispensers such as: pharmacists, hospitals, or medical centers that the containers have not been opened and the number of pills or volume of liquid contained in the container is accurate before providing it to the patients orconsumers.

A tamper-evident and child-resistant container (1) comprises a cap assembly (2) and a holder (3). The cap assembly includes an inner lid (5) that is being retained in the cavity of the outer lid (4), which has a tamper-evident disc (8) that is separate from the outer lid (4) through a precut channel (117) and is connected by frangible joints (80).

When the cap assembly (2) is initially rotated clockwise, closing to the container (1), the bead rear walls (100) of the tamper-evident disc (8) are pressed against the beads of the rearmost walls (108) of the inner lid. The complete closing of the container until the primary sealing surface (32) of the holder rim is completely pressed against the ceiling wall (130) of the inner lid.

When the cap assembly (2) is initially rotated counter-clockwise to open the container (1), the matching angle (92) of the protrusion ramp (110) of the inner lid is pressing against the protrusion ramp (106), which is located below the frangible joint of the tamper-evident disc (8). Thereby creating the wedging & prying effects that break the frangible joints (80) in the precut channel (117) between the outer lid (4) and the tamper-evident disc (8) as it ejects away from the cap and unattachable back to the outer lid. This visual indication that the container has clearly been tampered with. However, the container is still maintained as a closed condition with a child-resistant feature to prevent unwanted access by the young children.

The cap (4) continues to rotate counterclockwise about the center Z axis as a child-resistant feature, which the top side (122) of the push-tab (7) slides against the horizontal ramp (40) and intermittently indexes through the horizontal ramp crest (124) of the inner lid. The push-tab (7) has a resilient hinge (120) connecting by a two-hinged joint (118) on each side of the push-tab, retaining the push-tab at the neutral position as a child-resistant container. When the push-tab is pressed inward to the center Z axis, the front wall (132) of the pull-tab is engaged to the front wall (50) of the inner lid, thereby causing the outer lid and inner lid to connect together for unfastening of the cap (2) from the container (1).

It is the primary object of the invention is to use an innovative and intuitive tamper-evident and child safety lid packaging design that has a tamper-evident feature, or a disc on the top of the cap and a press-tab on the side wall that provides both tamper-evident and child safety features to warn and protect consumers.

It is an additional object of the invention in its use to provide a unique cap that allows the pharmacist to close it by turning it clockwise, for the first ($1^{st}$) time while the patient or consumer turns the cap counterclockwise to open it. However, this process will break off the tamper-evident disc away from the outside cap, which indicates tampering and exposes the upper surface of the inner lid, wherein the additional marking displays "OPENED" to warn of tampering. Thereon, the lid continues functioning as a child safety feature that requires pressing on the Push-Tab to open the container.

It is a further object of this invention to provide not only the pharmacists at the drug stores can use a tamper-evident and child safety packaging container after administering proper medication to the patients, but the manufacturers of medicines, vitamins, cosmetics, drinks, etc. can also use these packages to sell the products over the counter to reduce capital expenditures on equipment, materials and potentially mitigate missing medications from delivery or distribution at hospitals or medical centers from the opened container.

It is also an object of this invention to utilize a device that enhances Visual notifications to users that products are safe from tampering, it also increases consumer confidence in your brand. Although tamper-evident packaging does not protect the main product from being tampered with, but it does protect the consumer from using a medication, supplement, or products that has been compromised.

Historically, the implementation of tamper-evident label features via heat shrink-band and ultrasonic sealing has been restricted to the manufacturer's facility due to the substantial expense of the equipment required for installation. Consequently, this approach restricts the ability of small businesses or retailers to offer tamper-evident features for the purpose of safeguarding consumers and promoting distinctivebranding.

As such, it is still yet another object of this invention to utilize this device that allows for dispensers such as: pharmacists, hospitals, or medical centers, medical personnel to know that the containers have not been opened and the number of pills contained in the containers from the manufacturer are accurate.

Furthermore, not only can the pharmacists at the pharmacies being able to utilize child-safe and tamper-evident packaging containers to ensure that medications are administered to patients in the correct quantity and manner, but also enabling manufacturers of vitamins, cosmetics, medicines, and the like to sell their products over-the-counter, these containers can potentially reduce capital expenditures on equipment, materials and mitigate the risk of medications being lost during delivery or distribution at the hospital or medical centers from the opened container.

The advantages of this invention are evidently unique for consumers by providing an excellent package container with child safety and tamper-evident features that are aesthetically pleasing in appearance and reliability in operation.

It is an object of this invention to create a device that is easy to manufacture, reliable in operation, and relatively inexpensive to produce.

These and further objects of the invention will become apparent to those skilled in the relevant art, able to recognize after a study of the present disclosure of the invention and present similarities to depart the spirit of this origin innovation.

Furthermore, upon meticulous examination of this specification, including the detailed description provided below, numerous additional objects of this invention will become apparent.

BRIEF DESCRIPTION OF THE DRAWINGS

These as well as other features of the present invention will become apparent upon reference to the accompanying drawings wherein like numerals designate corresponding parts in the several figures, summarized as follows.

Although embodiments of the invention have been described and illustrated herein, it is recognized that modifications and variations may readily occur to those skilled in the art, and consequently, it is intended that the claims be interpreted to cover such modifications and equivalents.

DETAIL DESCRIPTION OF PREFERRED EMBODIMENT

The following detailed description and accompanying drawings are provided for the purpose of illustrating and describing precisely the preferred embodiments of the present invention and are not intended to limit the scope of the invention in any way. It will be understood that various changes in the details, material arrangements of parts, or operational conditions that have been herein described and illustrated to explain the nature of the invention may be made by those skilled in the art within the principles and scope of this invention.

Figure 1:
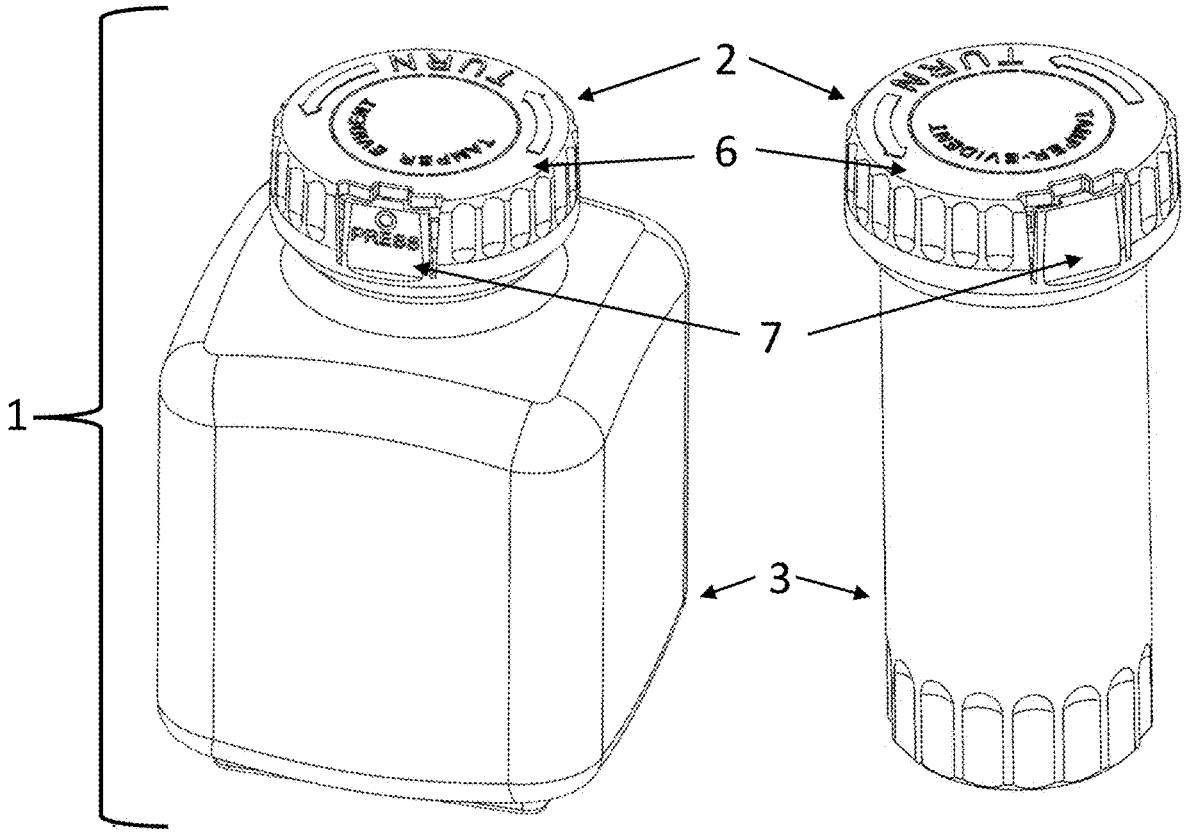
FIG. 1: Exhibits the Container and Capassembly.
Figure 2:
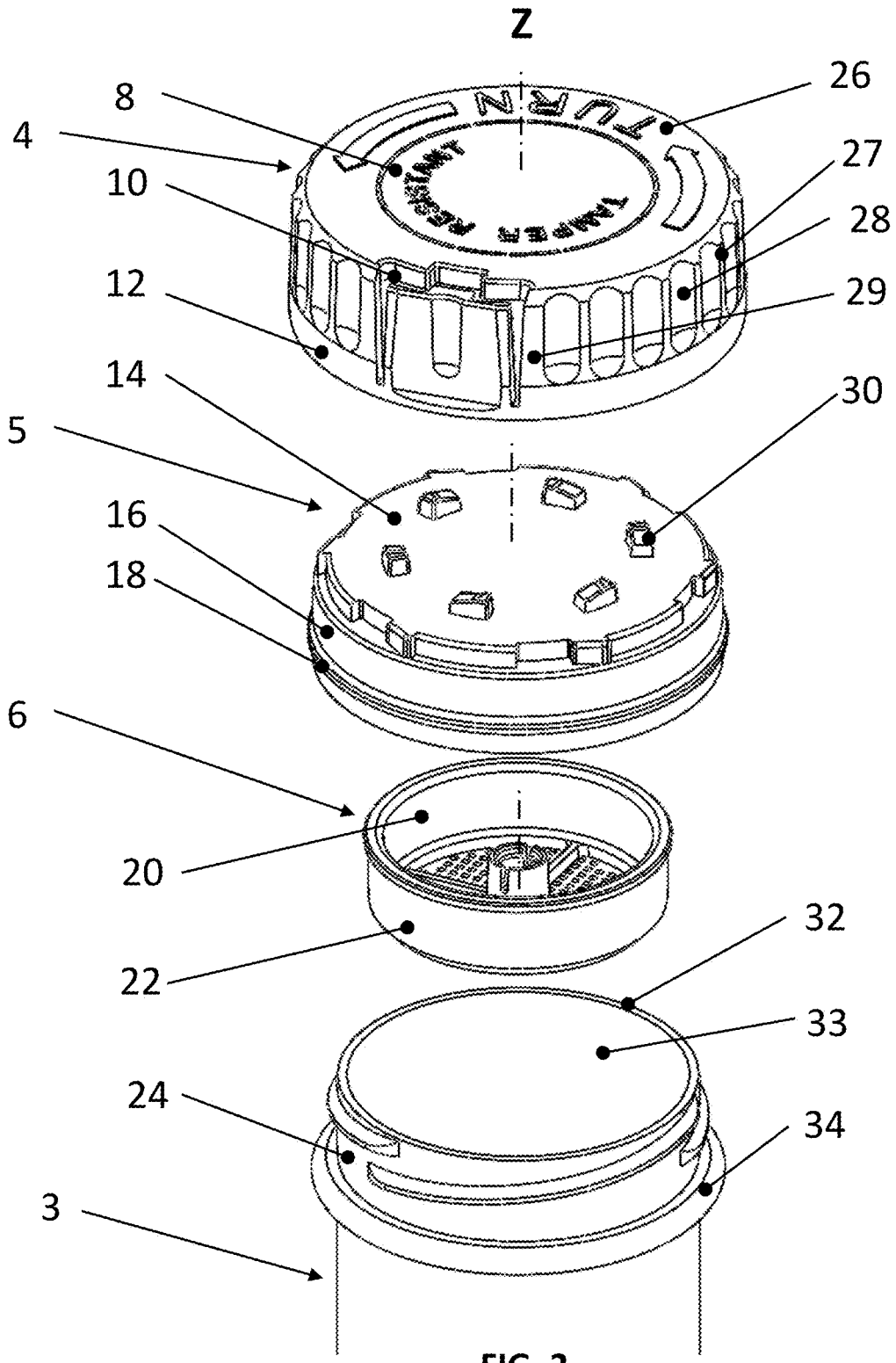
FIG. 2: Exhibits an explored view consists of the Outer Lid, Inner Lid, Desiccant container and Container.
Figure 2A:
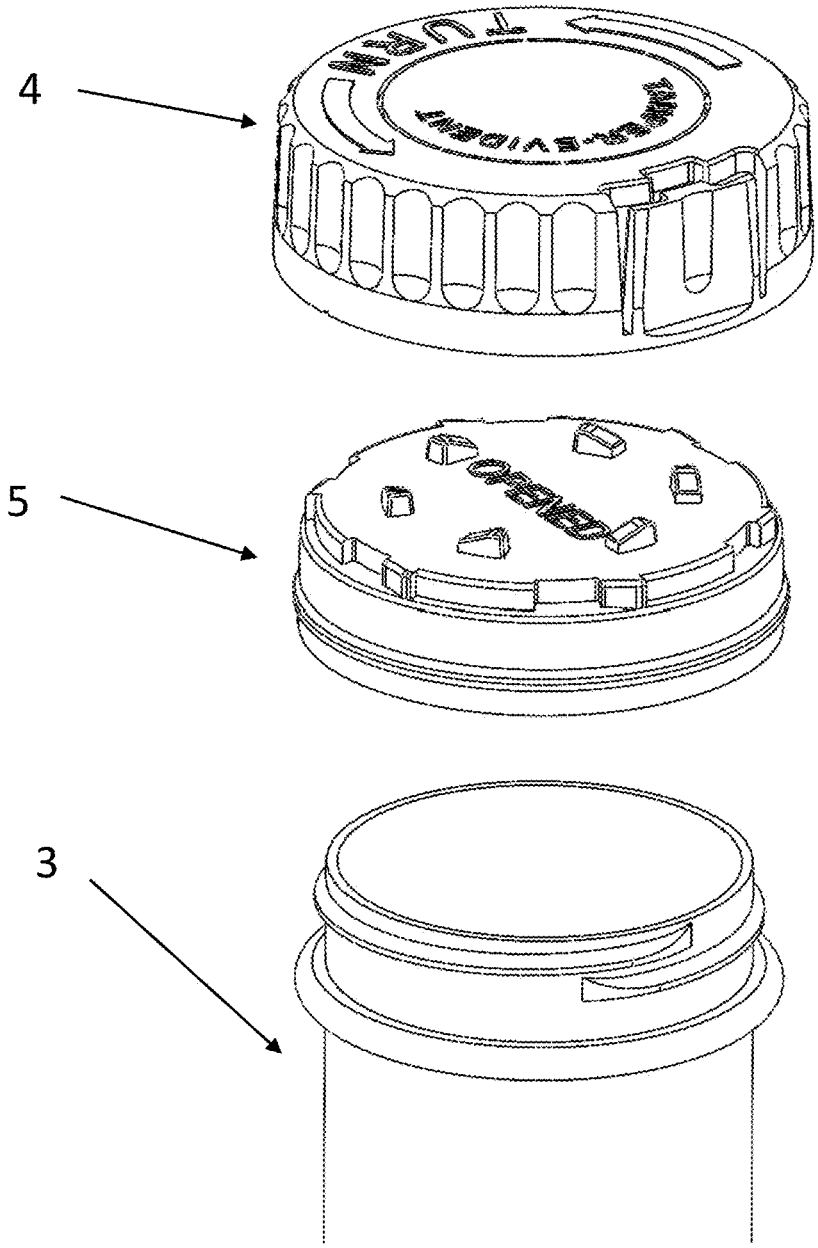
FIG. 2*a*: Exhibits an explored view consists of the Outer Lid, Inner Lid, andContainer.

The present invention will be further described in detail below with reference to its preferred embodiment:

Referring to FIGS. 1, 1*a* & 2 of the drawings, present the new invention of a tamper-evident and child-safety plastics packaging container is described through the illustrations. Based on this embodiment, the tamper-evident and child-safety packaging container (1) includes a cap assembly (2) attachable to the plastics or glass container (3). The cap assembly consists of two-components: the outer lid (4), the inner lid (5), and the desiccant basket (6). The outer lid has a push-tab (7) attached to the circular bottom wall (12) by two-hinged joint (118) on each side of the pivotal hinge (120) and spaced from the upper wall (26) by a clearance slot (10); an upper wall (26) of the outer lid is attached to a center tamper-evident disc (8) by the frangible joints (80—FIG. 7) whereas the through precut channel (117—FIG. 9) is separated these components, while the opposing side has multiple vertical outer wall (27), vertical serration grippers (28) and an outer vertical wall (29) radially surrounding the outer lid provide a positive hand gripping. The inner lid (5) has an upper wall (14) whereas the lower beads (30) are located radially from the center Z axis of the inner lid, and the vertical sidewall (16) and the radial retainer (18) define the outer wall of the inner lid. A desiccant basket (6) has an inner surface (20) and an outer surface (22) to fit the cavity of the below inner lid. FIG. 1*a* shows without the desiccant basket, which is an optional component to prolong the shelf-life of the products or medicines when it is applied. A plastics or glass container (3) can be made in various shapes and sizes with the cavity inner wall (33) and the container outer wall (24) jointed by the container rim (32). A neck ring (34) is located below the male fastener that prevents tampering from prying, and an array of gripping recesses is located below of the round or square container wall (24) to facilitate the opening of the packaging container.

Figure 3:
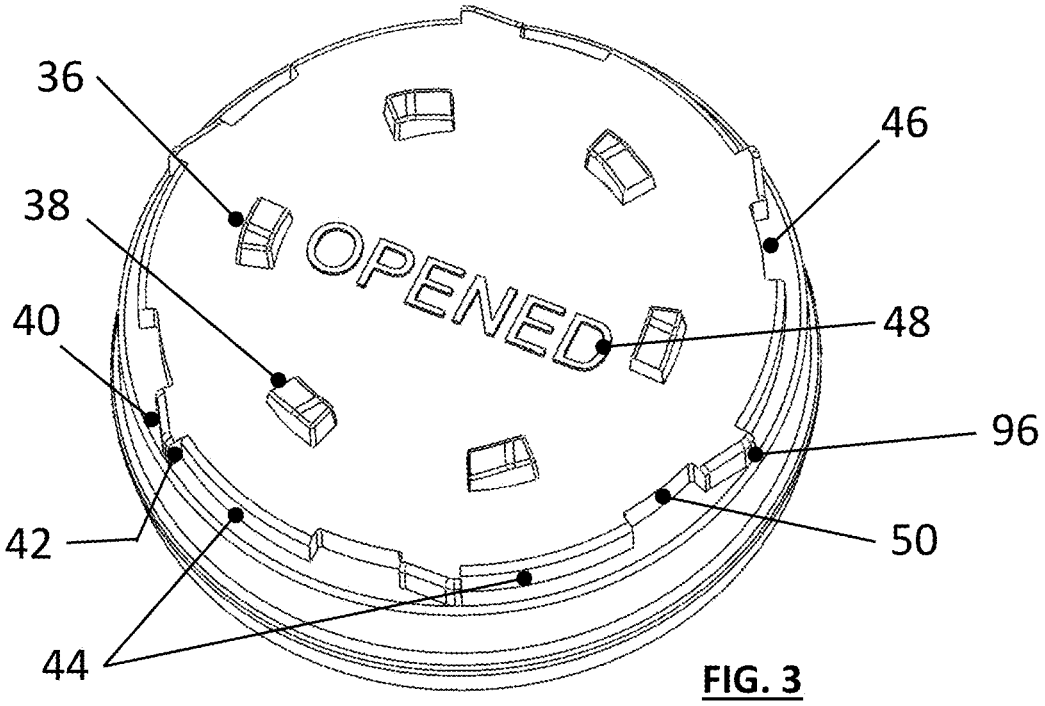
FIG. 3: Exhibits the top view of the InnerLid.
Figure 4:
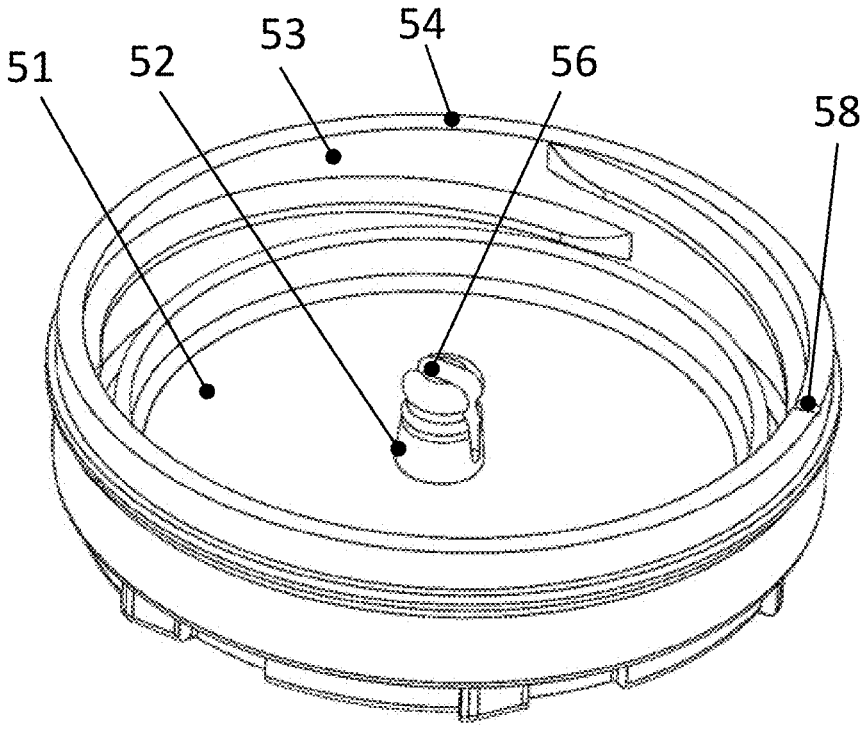
FIG. 4: Exhibits an inverted view of the Inner Lid with a Center Snap-on Post, and assembled marking on the rim.

Referring to FIGS. 3 & 4 of the drawings, a tamper-evident and child-safety plastics packaging container has an inner lid (5) of the cap assembly, wherein the upper wall has a bead protrusion ramp (36) and bead protrusion front wall (38), and a tamper-evident text warning (48) can be marked, molded, or printed. Adjacent to the upper wall is a vertical wall (44), a horizontal ramp (40), and a front wall (42) to facilitate counterclockwise when the outer lid rotates and functionally indexed as a child safety feature. However, the horizontal ramp crest (96) (FIG. 7) protrudes slightly outward, allowing the outer lid easy to rotate clockwise when closing and tightening the cap assembly (2). FIG. 4 shows an inverted view of the inner lid, wherein the cavity bottom wall (51) has a snap-on base (52) with a collapsible slot (56) attaching to the desiccant container. The bottom rim (54) has at least an alignment mark (58) to assist in the assembly of the inner and the outer lid, while the inner lid vertical wall (53) has a female fastener (136) system or standard connections such as a twist-lock, screwed, threaded, etc. configuration that is compatible coupling with the plastics or glass container (3).

Figure 5:
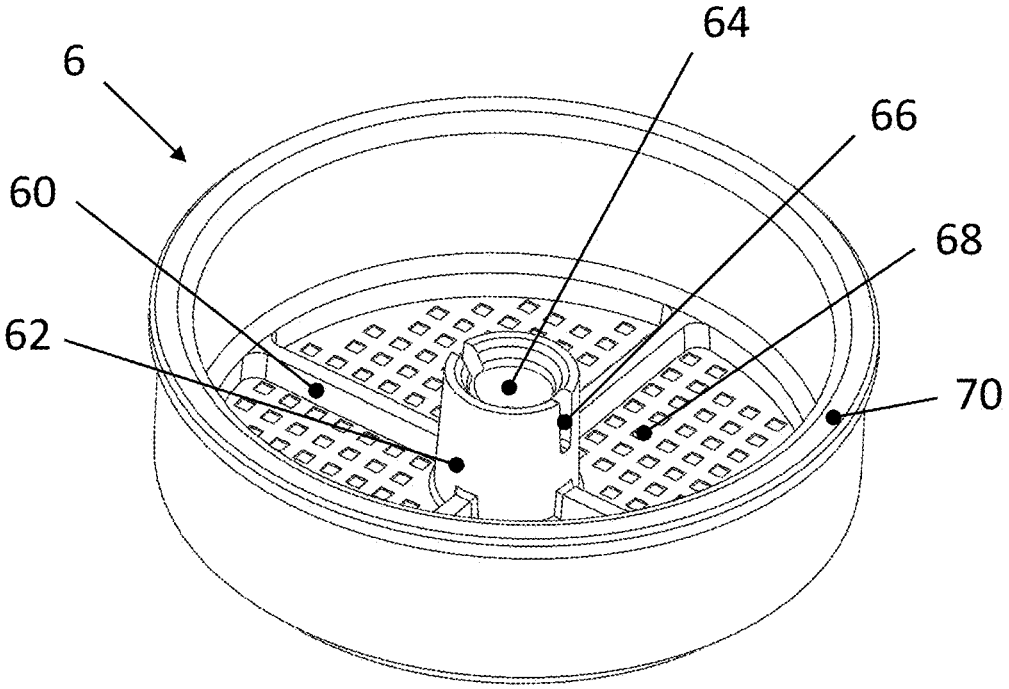
FIG. 5: Exhibits a Desiccant container with a Center Snap-on Post, including the support ribs and the transmission holes.
Figure 5A:
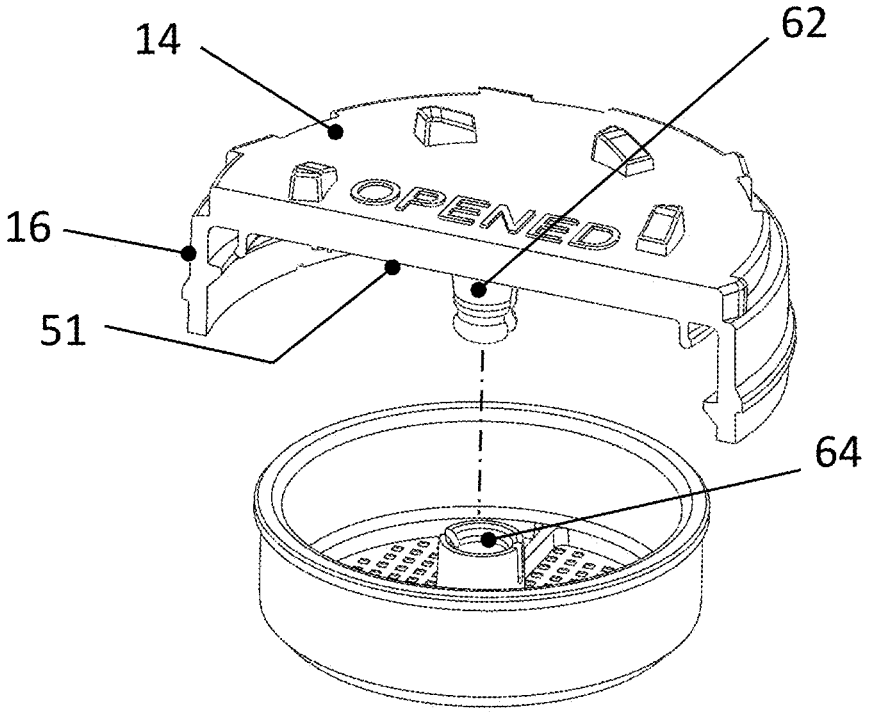
FIG. 5*a*: Exhibits a Desiccant container with a Center Snap-on Post, aligning to the bottom of the inner lid.
Figure 6:
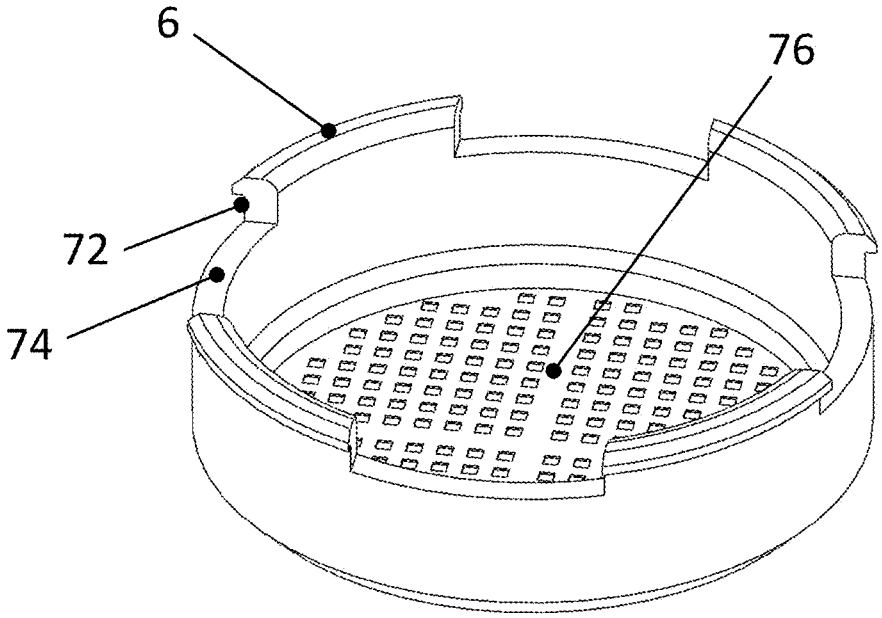
FIG. 6: Exhibits a Desiccant container with perimeter Snap-lock and bottom wall having the transmission holes.

Referring to FIGS. 5, 5*a* & 6 of the drawings, a tamper-evident and child-safety plastics packaging container, a desiccant container (6) has a bottom wall (76) and support ribs (60) connecting to the internal surface and the center post snap-on (62) with the internal cavity (64) wherein a through slot (66) protrudes through the sidewall of the post to provide the flexibility for the snap-on feature. The perimeter rim (70) connects to the outer wall (22) to provide the rigidity of the desiccant container when it is rested against the bottom wall of the inner lid. Other option by having the desiccant container as pre-sealed attachment. FIG. 5*a* exhibits the alignment of the snap-om between the center post (62) and the snap-on base (52). FIG. 6 of the drawing, the perimeter rim (70) has released slots (74) that form the external snap-on (72) feature that are mated with the cavity of the inner lid.

Figure 7:
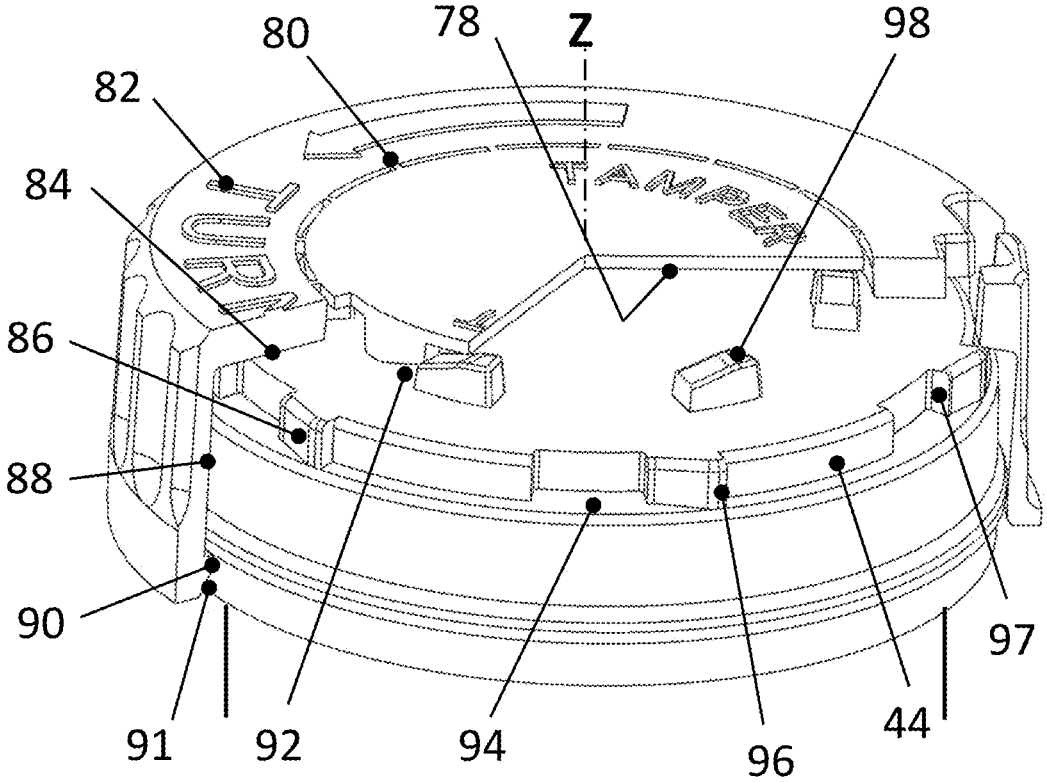
FIGS. 7 & 7*a*: Exhibit a partial section of the Outer Lid and the opening process of breaking the frangible joint by turning the cap counterclockwise, and wedging between the bead protrusion or recess to eject the Tamper-Evident Disc from theCap.
Figure 7A:
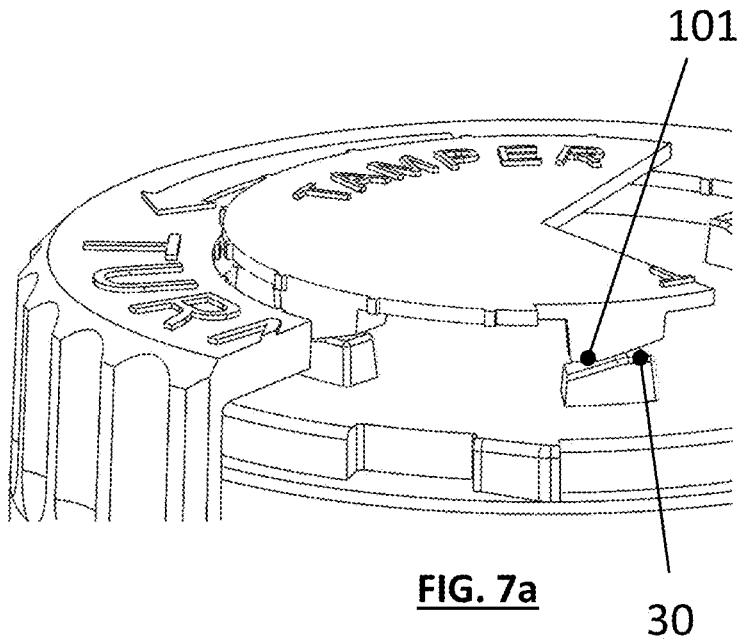

Referring to FIGS. 7 & 7*a* of the drawing, a tamper-evident and child-safety plastics packaging container has a partial cross-section of the outer lid (4) being cut to show the detailed components and functionality of the cap assembly (2) when the cap rotates about the centerZaxis. The outer lid has an upper wall (28) that can be marked or molded with instructional guidance (82) for opening the container, and it connects to a center tamper-evident disc (8) by the frangible joint (80). The bottom surface (78) of the tamper-evident disc is a thin section of material where the upper bead protrusions and/or recesses (101) are located circularly and rotationally aligned with the opposing members, protrusions or recesses, (30, FIG. 3) from the centerZaxis. These configurations have matching angles (92) of the protrusion or recess ramps, whereas the ramp (106) of the tamper-evident feature and the ramp (110, FIG. 8) of the inner lid are wedged against each other to break the frangible joint and raise up the tamper-evident disc when rotated counterclockwise to open the container. The bottom surface (84) is slightly spaced from the upper wall (14) of the inner lid, providing sufficient clearance for these lids to rotate freely. Below the upper wall (14) of the inner lid is a ledge surface (94) connecting to the vertical sidewall (16) and a circular ring (18). The vertical outside wall (44), a closing ramp (86), the horizontal ramp crest (96), and the recess sidewall (97) are located between the upper wall (14) and the ledge surface to facilitate closing the packaging container. The cylindrical wall (88) and radial retainer (90) hold the inner lid and the outer lid together, while the leading chamfer (91) is used for easing the assemblyprocess.

Figure 8:
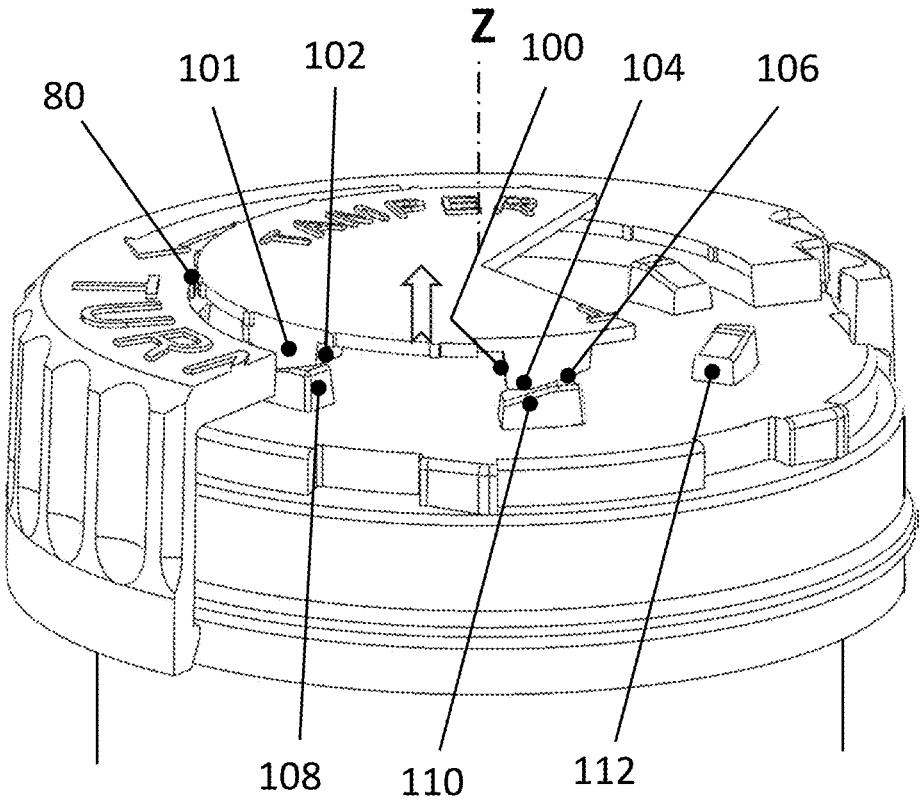
FIG. 8: Exhibits a cross section of the upper lid and the Tamper-Evident Disc ejected after breaking frangible joint by turning the Cap in a normal opening action.
Figure 9:
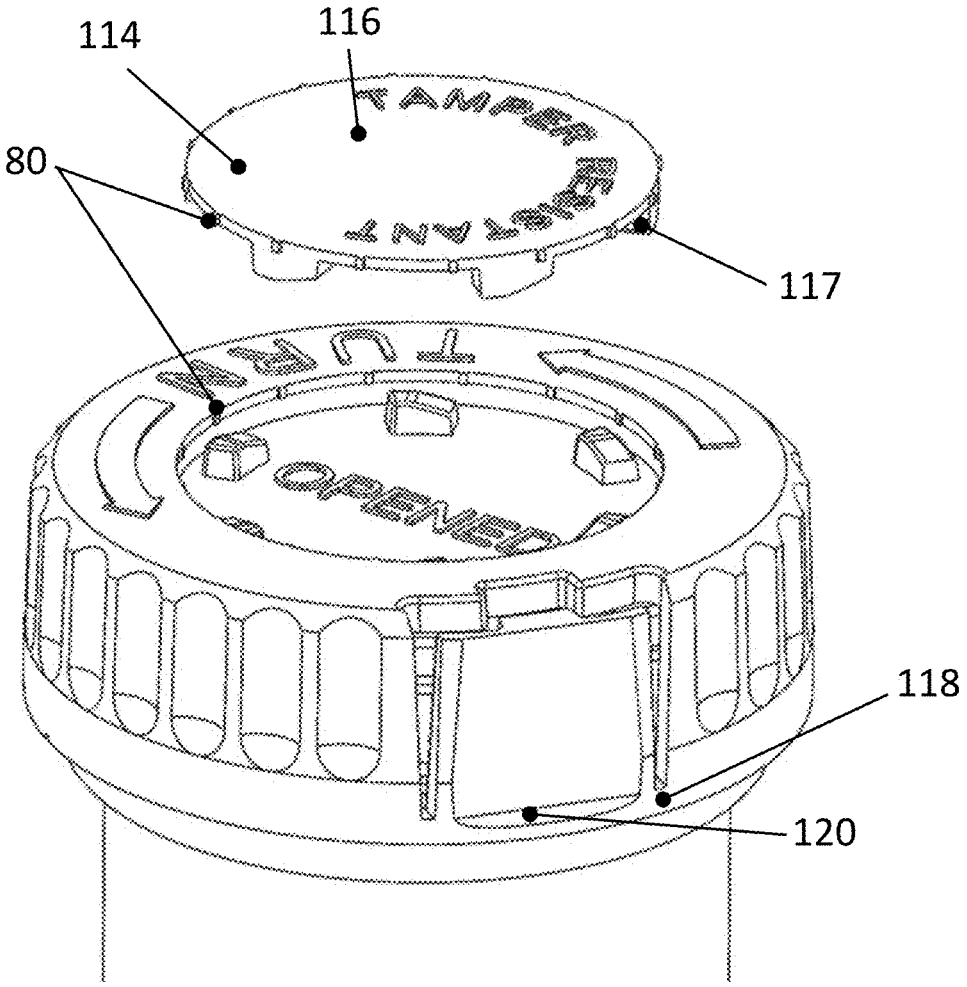
FIG. 9: Exhibits the functionality of the Tamper-Evident Disc detaching from the cap, thereby exposing the inner lid. The explicit inscription "OPENED" on the upper surface of the inner lid serves as a warning sign of tampering. Thereon, the cap continues functioning as a child safety container. The obviousness of tampering can also be determined by other symbols, engraved text, color, etc.

Referring to FIGS. 8 & 9 of the drawings, similarly to FIG. 7, a partial cross-section of the outer lid (4) shows the detailed components and functionality of the plastics cap assembly, wherein the outer cap is being rotated counterclockwise for opening, the bead upper ramp (106) of the tamper-evident disc (8) wedging against the bead lower ramp (110) until both of these ramps reach the bead upper surface (98) of the inner lid and the bead upper surface (104). The frangible joint (80) are broken during this opening process, and the tamper-evident disc (8) is separated and ejected away from the outer lid. The bead front wall (102) and the bead rear walls (100) of the tamper evident disc, and the frontal wall (112) and the rearmost wall (108) are positioned in such a way that prevents them from colliding when closing the packaging container. In FIG. 9 of the exploded drawing, the tamper-evident disc has the instructional text (116) on the top upper wall (114) with marking or molding of the tamper-evident, wherein the tamper-evident disc is separated from the outer lid (4) by a through precut channel (117) and exposed to the upper wall and warning of the inner lid. A push-tab is located on the sidewall of the outer lid and attached by two hinged joint (118) between the pivotal hinge (120).

Figure 10:
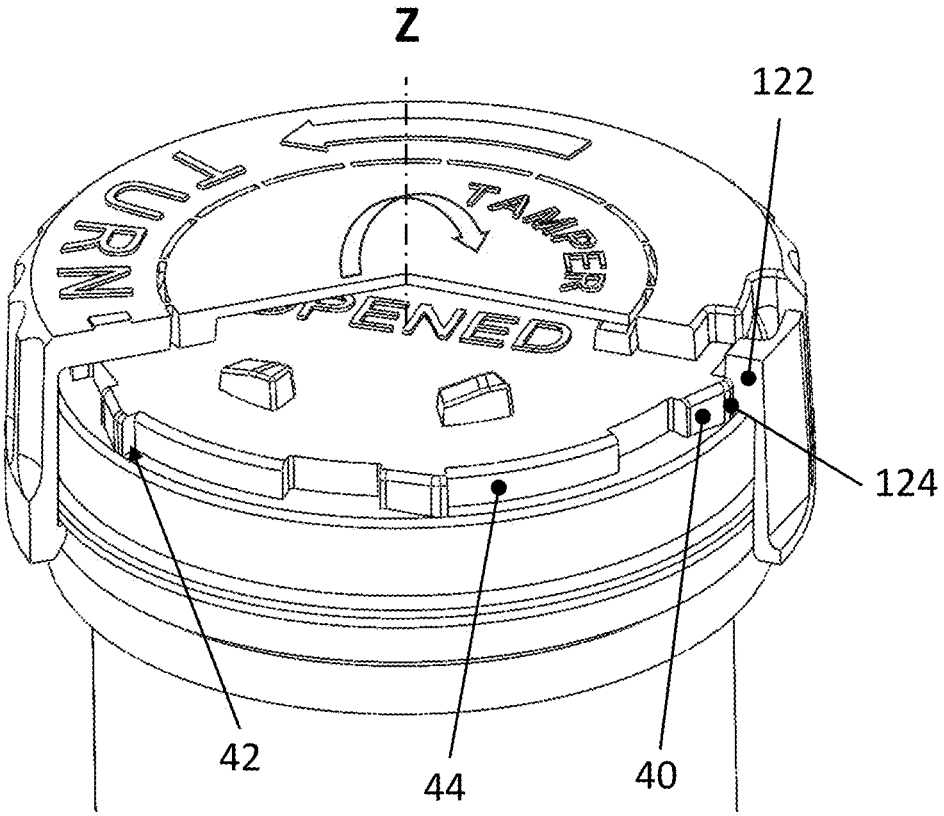
FIG. 10: Exhibits the closing and tightening of the cap, wherein the vertical sidewall of the Press-Tab is pressing against the front wall of the inner lid to tighten the cap.
Figure 11:
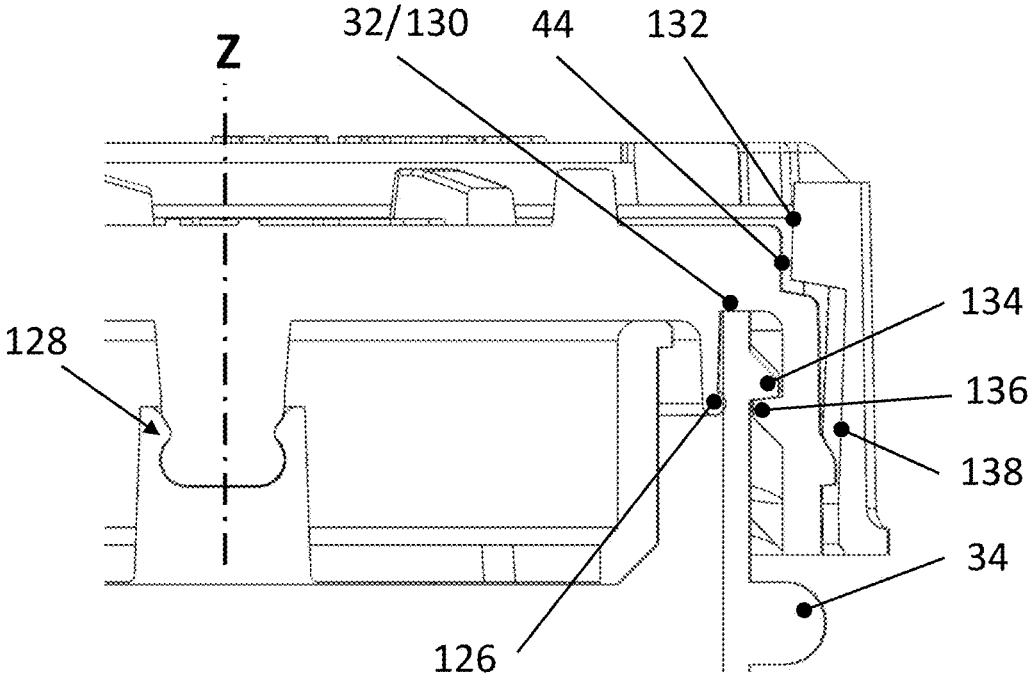
FIGS. 11 & 11*a*: Exhibits cross-sections of the package container, wherein the snap-on center post connecting the desiccant container to the bottom of the Inner Lid, and the shut-off/sealing between the container rim to the ceiling wall, and clearance gap between vertical upper wall of the inner lid and the front wall of the press-tab. It also exhibits a standard female & male fastening system (i.e. twist-lock, screws, threads) keeps the cap and container together, and a lip seal or a matching angle sidewall provides a secondary seal between the inner lid and the container.

Referring to FIGS. 10 & 11 of the drawings, a tamper-evident and child-safety plastic packaging container with a partial cross-section of the outer lid (4) is being cut to show the detailed components and functionality of the cap assembly (2). When the cap rotates clockwise about the center-Zaxis, the top sidewall (122) of the push-tab is pressed against the front wall (42) of the inner lid in a neutral position to close and tighten the cap. By turning the cap counterclockwise, the front wall (132) of the push-tab is spaced from the vertical wall (44), and it is intermittently pressed against the ramp crest (124) of the inner lid. FIG. 11 is a full cross section that also exhibits the primary sealing of the surface (32) of the container rim and the ceiling wall (130) of the inner lid. The secondary lip seal (126) of the inner lid circularly presses against the inner wall (33) or the edge of the container to provide a positive seal, the lip seal (126) has a spherical radius or having a radius surface more than 90 degrees

Figure 11A:
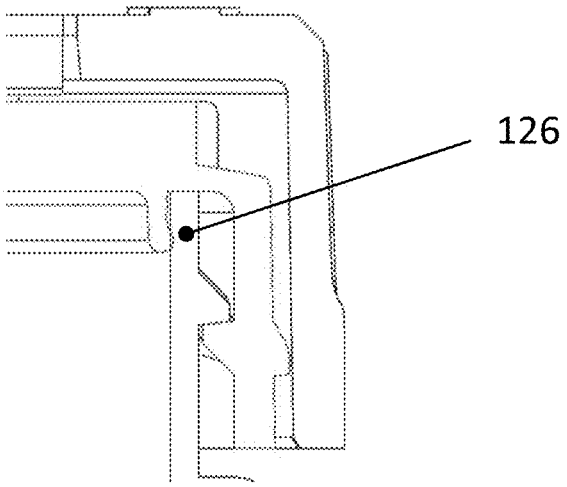

[see FIG. 11*a*] or two matching angle surfaces of the inner lid and the inner wall of the container to prevent the transmission of the elements into the container. A standard fastener method of the female fastener (136) and male fastener (134) type, or the like twist lock, threaded, screwed type, with quick ¼ or ⅓ turn or release, etc., can be used to keep the cap assembly (2) and container (3) coupling together, while the neck ring (34) prevents tampering.

Figure 12:
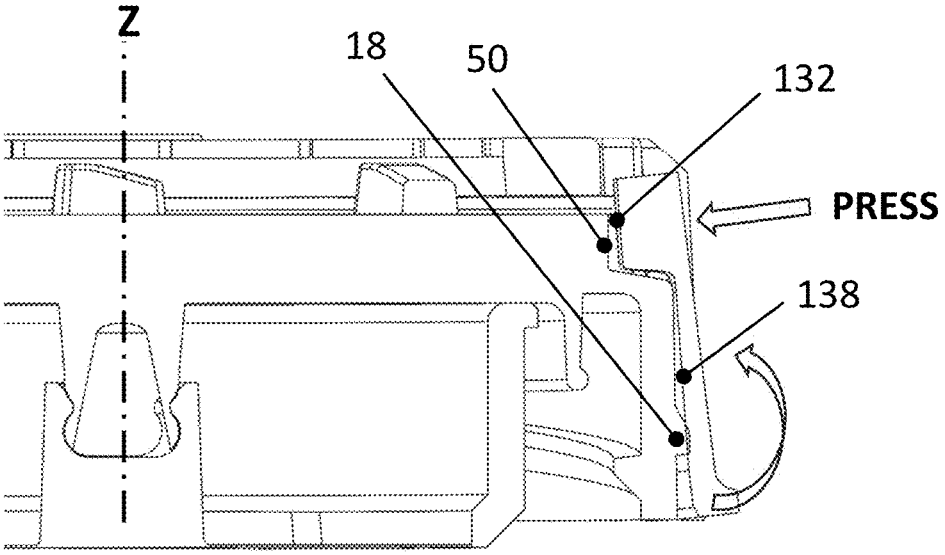
FIG. 12: Exhibits pressing the upper side of the press-tab, wherein the front wall is close to the recess front wall, and the sidewall of the press-tab rests against the recess sidewall of the inner lid. Apart from the resilient pivotal hinge, it also exhibits the press-tab pressing on the radial retainer, which tends to deflect the press-tab back to the upright neutral position when the hand pressure is relieved.

Referring to FIG. 12 of the drawing, a tamper-evident and child-safety plastics packaging container, a cross-section shows without the container, wherein the pressure is being applied by the finger pressing on the top portion of the push-tab (7), so the front wall (132) is engaged within the recess groove (46) and flexed toward the recess front wall (50), causing the outer lid and inner lid to connect together for unfastening of the cap. The vertical sidewall (138) of the push-tab (7) is pressed against the radial ring (18) of the inner lid, which allows it to flex back to the neutral vertical position when the finger is released.

While the description above refers to particular embodiments of the present invention, it will be understood that many modifications may be made without departing from the spirit thereof. The presently disclosed embodiments are therefore to be considered in all respects as illustrative and not restrictive. Furthermore, it is recognized that modifications and variations may readily occur to those skilled in the art, and consequently, it is intended that the claims be interpreted to cover such modifications and equivalents in the similar and/or related claims.

I claim:

1. A method of using a tamper-evident and child-resistant container comprising:

providing a container having a standard twist lock or fastener method connecting to a cap including:

an outer lid having a center tamper-evident disc that is separate from said outer lid by a precut channel and connected by a frangible joint;

said outer lid having a push-tab disposed on a sidewall that is connected by one end as a hinged joint and resiliently maintained in a neutral position after multiple times of pressing;

an inner lid having a standard twist lock or a fastening method that connects to the container;

said inner lid is inserted and retained in a cavity of the outer lid and is rotatable about a Z axis;

said inner lid having a protrusion and/or recess ramp that is radially disposed and aligned to an outer lid ramp to facilitate breaking said frangible joint of a tamper-evident disc; and said inner lid having a vertical wall and a mating recess or raise radially disposed and aligned to a front end of a push-tab to facilitate an opening of a child-resistant container.

2. A method of using a tamper-evident and child-resistant container according to claim 1, wherein by pressing the push-tab on the sidewall of the cap facilitates the opening of the child-resistant container.

3. A method of using a tamper-evident and child-resistant container according to claim 1, wherein by rotating the cap clockwise, it is tightened to the container.

4. A method of using a tamper-evident and child-resistant container according to claim 1, wherein by rotating the cap counterclockwise, it will cause breaking of said frangible joint, thereby separating the tamper-evident disc from the cap and showing proof of tampering.

5. A method of using a tamper-evident and child-resistant container according to claim 1, wherein said after breaking the frangible joint by rotating the cap, the outer lid is freely rotatable counterclockwise about the Z axis as a child-resistant feature.

6. A method of using a tamper-evident and child-resistant container according to claim 1, wherein said cap having a protrusion ramp that is radially aligned with an opposing member when the cap is rotated counterclockwise, breaking the frangible joints, and prying the tamper-evident disc away from the cap to indicate tampering.

7. A method of using a tamper-evident and child-resistant container according to claim 1, further comprising a bottom cavity of the inner lid having a snap-on feature to retain a desiccant container.

8. A method of using a tamper-evident and child-resistant container according to claim 1, further comprising an alignment marking is used to facilitate the orientation between the inner lid and the outer lid for assembly.

9. A method of using a tamper-evident and child-resistant container according to claim 1, further comprising the container or said lid having materials that are chosen from a group consisting of metals, thermoplastics, thermosets, composite materials, or a combination thereof.

10. A method of using a tamper-evident and child-resistant container according to claim 1, further comprising the container or said lid are manufactured using techniques that are chosen from a group consisting of injection molding, blow molding, thermoforming, stamping, casting processes, or a combination thereof.

11. A method of making a tamper-evident and child-resistant container consists of the following steps:

providing a container that is made in various shapes and sizes;

providing the container having an opening on an outer wall having a standard twist lock method or fastener system for connecting to a cap;

providing said cap that is made in various shapes and sizes and that is attachable and engageable with the container;

providing said cap having:

an outer lid with a tamper-evident feature is connected to an upper wall by a frangible joint, wherein a precut channel is spaced between said upper wall and said frangible joint;

said outer lid having a push-tab is disposed on a sidewall, said to connect by one end as a hinged joint, and is resiliently maintained in a neutral position after multiple pressing;

said outer lid having the push-tab is disposed on the sidewall, said is maintained in a neutral position when the cap is freely rotated counterclockwise as a child resistant feature without opening the container;

said outer lid having a serration grippers disposed on the sidewall to facilitate the opening of the container;

an inner lid having a protrusion or recess is radially disposed on the upper wall and aligns with an opposing member on a lower surface of a tamper-evident disc;

wherein pressing the push-tab on the sidewall of the cap facilitates opening of the container;

wherein rotating the cap clockwise is tightened to the container;

wherein rotating the cap counterclockwise will cause breaking of said frangible joint, thereby separating the tamper-evident disc from the cap and thereby showing proof of tampering; and wherein said after breaking the frangible joint by rotating the cap, the outer lid is freely rotatable about a Z axis as the child-resistant feature.

12. A method of making tamper-evident and child-resistant features according to claim 11, further comprising the inner lid having a snap-on feature connects to a desiccant container.

13. A method of making tamper-evident and child-resistant features according to claim 11, further comprising a desiccant container having a transmissible hole.

14. A method of making tamper-evident and child-resistant features according to claim 11, wherein a matching angle of protrusion or recess is radially aligned to break and pry the tamper-evident disc away from the cap after the frangible joint is broken.

15. A method of making tamper-evident and child-resistant features according to claim 11, wherein said inner lid having a horizontal ramp crest protruded slightly outward, allowing the outer lid rotates clockwise when closing and tightening the cap.

16. A method of making tamper-evident and child-resistant features according to claim 11, wherein said inner lid and said outer lid are made from polymers chosen from a group consisting of injection molding, blow molding, thermoforming process or a combination thereof.

17. A method of making tamper-evident and a child-resistant container according to claim 11, wherein said inner lid having the upper wall, a vertical wall, a horizontal ramp, and a ramp crest to allow the outer lid rotating and indexing as a child safety feature.

18. A method of making tamper-evident and a child-resistant container according to claim 11, wherein said inner lid having a horizontal ramp crest protruded slightly outward, allowing the outer lid rotates clockwise when closing and tightening the cap.

19. A method of making a tamper-evident container comprised of components:

providing a container having a standard twist lock method or a fastener system connecting to a cap;

providing said cap is engageable with the container having:

an outer lid having a tamper-evident component that is deposed on a top surface, and is separated by a precut channel, and is connected by a frangible joint between said outer lid and said tamper-evident component;

by rotating the outer lid, breaks the frangible joint and separates a tamper-evident component from the cap, and thereby showing proof of tampering; and an inner lid is placed and retained inside a cavity of the outer lid by a retainer and is rotatable about a Z axis; wherein said inner lid has a horizontal ramp crest protruded slightly outward, allowing the outer lid rotates clockwise when closing and tightening the cap.

20. A method of making a tamper-evident container according to claim 19, wherein a protrusion ramp is radially aligned with an opposing member when the cap is rotated, breaking the frangible joint, and prying a tamper-evident disc away from the cap to indicate tampering.

21. A method of making a tamper-evident container according to claim 19, wherein said inner lid having an upper wall, a vertical wall, a horizontal ramp, and a ramp crest to allow the outer lid rotating and indexing as a child safety feature.

22. A method of making a tamper-evident container according to claim 19, further comprising a sign located on the upper wall of the inner lid the visually indicate tampering has occurred when said tamper-evident disc is broken away from said cap that indicates tampering, wherein said sign indicating tampering has occurred chosen from a group consisting of color, symbol, word, or other indication.

23. A method of making a tamper-evident container according to claim 19, further comprising a bottom cavity of the inner lid having a snap-on feature to retain a desiccant container.

24. A method of making a tamper-evident container according to claim 19, further comprising an alignment marking is used to facilitate an orientation between the inner lid and the outer lid for assembly.

25. A method of making a tamper-evident container according to claim 19, further comprising a lip seal wall is pressed against an inner wall or an inner edge of the container.

26. A method of making a tamper-evident container according to claim 19, further comprising a lip seal having one or more matching angle sidewalls to provide a seal between the inner lid and the container.

27. A method of making a tamper-evident container according to claim 19, further comprising a cavity of the inner lid having a snap-on feature attached to a desiccant container.

28. A method of making a child-resistant container comprises the steps of:

providing a container having a standard twist lock feature or fastener method for connecting to a cap;

providing said cap that is engageable with the container having:

an inner lid that is retained inside a cavity of an outer lid and that is rotatable about a Z axis;

providing said outer lid having a child-resistant feature with a push-tab including:

said push-tab is disposed on a sidewall, connected by one end to the outer lid, which functions as a pivotal hinge and spaced from a sidewall by a clearance slot;

said push-tab is resiliently maintained in its neutral position after multiple usages of pressing; and said push-tab having a front wall spaced from a vertical wall and a raise or recess of the inner lid, and said outer lid is rotatable and functions as a child-resistant feature when it is in a neutral position.

29. A method of making a child-resistant container according to claim 28, wherein said by pressing the push-tab of the outer lid causes the front wall to engage into the raise or recess of the inner lid, thereby allowing the cap to facilitate opening the container.

30. A method of making a child-resistant container according to claim 28, wherein said by rotating the cap clockwise about the z axis, said cap is tightened to the container.

31. A method of making a child-resistant container according to claim 28, further comprising said push-tab that is connected by two joints, one on each side, functioning as a pivotal hinge said resiliently keeping the push-tab in its neutral position after multiple usages of pressing.

32. A method of making a child-resistant container according to claim 28, wherein said inner lid having at least a recess disposed adjacent to the vertical wall and radially from the z axis.

33. A method of making a child-resistant container according to claim 28, further comprising a sealing surface is contacted between a bottom wall of the inner lid and the container rim.

34. A method of making a child-resistant container according to claim 28, further comprising a lip seal wall is pressed against the inner wall or inner edge of the container.

35. A method of making a child-resistant container according to claim 28, further comprising a lip seal having a matching angle sidewall to provide a secondary seal between the inner lid and the container.

36. A method of making a child-resistant container according to claim 28, further comprising a cavity of the inner lid having a snap-on feature attached to a desiccant container.

37. A method of making a child-resistant container according to claim 28, wherein said inner lid having an upper wall, a vertical wall, a horizontal ramp, and a ramp crest to allow the outer lid rotating and indexing as a child safety feature.

38. A method of making child-resistant container according to according to claim 28, wherein said inner lid having a horizontal ramp crest protruded slightly outward, allowing the outer lid rotates clockwise when closing and tightening the cap.

39. A method of making a tamper-evident and child-resistant container consists of the following steps:

providing a container that is made in various shapes and sizes;

providing the container having an opening on an outer wall having a standard twist lock method or fastener system for connecting to a cap;

providing said cap that is made in various shapes and sizes and that is attachable and engageable with the container;

providing said cap having:

an outer lid having a tamper-evident feature is connected to an upper wall by a frangible joint, wherein a precut channel is spaced between said upper wall and said frangible joint;

said outer lid having a push-tab is disposed on a sidewall, said to connect by one end as a hinged joint, and is resiliently maintained in a neutral position after multiple pressing;

said outer lid having said push-tab is disposed on the sidewall, said is maintained in a neutral position when the cap is freely rotated counterclockwise as a child resistant feature;

an inner lid having a protrusion or recess is radially disposed on the upper wall and aligns with the opposing member on a lower surface of a tamper-evident disc, said by rotating the cap clockwise is tightened the container, and said by rotating the cap counterclockwise breaks a frangible joint in a precut channel and separates a feature of the tamper-evident disc from the cap; and wherein the cap becomes more freely rotating about a z axis as a child-resistant feature.

40. A method of making a tamper-evident and child-resistant container according to claim 39, wherein the container or said lid are made from materials chosen from a group consisting of: metals, plastics, polymers, composite materials, or a combination thereof.

* * * * *